United States Patent [19]

Shapiro et al.

[11] 4,242,133

[45] Dec. 30, 1980

[54] COPPER BASE ALLOY CONTAINING MANGANESE

[75] Inventors: Eugene Shapiro, Hamden; John M. Vitek, Cheshire; Warren F. Smith, Jr., Branford, all of Conn.

[73] Assignee: Olin Corporation, New Haven, Conn.

[21] Appl. No.: 74,536

[22] Filed: Sep. 11, 1979

[51] Int. Cl.[3] ..... C22C 9/04

[52] U.S. Cl. ..... 75/157.5; 75/161; 75/162; 148/11.5 C; 148/13.2

[58] Field of Search ..... 75/157.5, 161, 162; 148/11.5 C, 13.2

[56] References Cited

U.S. PATENT DOCUMENTS

| | | | |
|---|---|---|---|
| 1,869,554 | 8/1932 | Ellis | 75/157.5 |
| 2,101,930 | 12/1937 | Davis et al. | 75/157.5 |
| 2,400,234 | 5/1946 | Hudson | 75/157.5 |
| 2,479,596 | 8/1949 | Anderson et al. | 75/157.5 |
| 2,494,736 | 1/1950 | Berwick | 75/157.5 |
| 3,402,043 | 9/1968 | Smith | 75/157.5 |
| 3,764,306 | 10/1973 | Blythe et al. | 75/157.5 |
| 3,841,921 | 10/1974 | Shapiro et al. | 148/11.5 C X |
| 3,941,619 | 3/1976 | Shapiro et al. | 148/11.5 C X |
| 4,025,367 | 5/1977 | Parikh et al. | 148/11.5 C |

FOREIGN PATENT DOCUMENTS

| | | | |
|---|---|---|---|
| 853620 | 10/1970 | Canada | 75/157.5 |
| 833288 | 4/1960 | United Kingdom | 75/157.5 |
| 838762 | 6/1960 | United Kingdom | 75/157.5 |

*Primary Examiner*—Dean R.
*Assistant Examiner*—W. G. Saba
*Attorney, Agent, or Firm*—Paul Weinstein

[57] ABSTRACT

A copper base alloy having improved stress relaxation resistance consisting essentially of: about 15.0 to 31% zinc; about 1.0 to 5.0% aluminum; about 1.1 to 8% manganese; and the balance copper.

10 Claims, No Drawings

COPPER BASE ALLOY CONTAINING MANGANESE

BACKGROUND OF THE INVENTION

Material used for spring connection devices must exhibit the ability to maintain adequate contact pressure for the design life of any part formed from the material. The maintenance of adequate contact pressure requires the ability of the material to resist stress relaxation over a period of time especially at elevated temperatures above normal room temperature. The current trend in connector design has been to place greater emphasis upon the maintenance of high contact pressure on connector parts at mildly elevated temperatures to reduce problems which might develop as the surface temperatures of the parts increase. CDA Alloy C68800 is currently widely used for electrical connectors but tends to exhibit a less than desired stress relaxation resistance at temperatures of 75° C. or higher. Accordingly, it is desirable that alternative alloys be provided having improved elevated temperature stress relaxation performance.

It is important in any such alloys that a reasonable level of conductivity be maintained along with the improved stress relaxation performance. Furthermore, bend formability should be maintained as well as adequate strength properties. Other performance characteristics such as stress corrosion, solderability and softening resistance should not be significantly below those properties exhibited by the commercial CDA Alloy C68800. It is desired in accordance with this invention that the improved alloy exhibit approximately a 10 to 30% increase in projected stress remaining after 100,000 hours at 105° C. relative to the commercially available CDA Copper Alloy C68800. That alloy is included within the limits of U.S. Pat. No. 3,402,043 to Smith.

It has surprisingly been found that when an aluminum brass is modified through the addition of manganese within specific limits its stress relaxation performance is substantially improved while maintaining excellent strength and bend properties and with a limited degree of conductivity loss.

Various attempts have been made to improve the stress relaxation performance of CDA Copper Alloy C68800 and related alloys and also to improve other properties of these alloys by modification of their processing as exemplified in U.S. Pat. Nos. 3,841,921 and 3,941,619 to Shapiro et al. and 4,025,367 to Parikh et al. The Shapiro et al. U.S. Pat. No. 3,841,921 patent is particularly pertinent in that it deals with improving the stress relaxation resistance of the desired alloys which are broadly defined and which may include up to 10% manganese as one of many possible alternative alloying additions.

U.S. Pat. No. 1,869,554 to Ellis is of interest and it discloses a brass alloy including 2 to 7% manganese. The alloy comprises a beta or alpha plus beta alloy and generally includes a level of zinc well above that included in the alloy of the present invention. In U.S. Pat. No. 3,764,306 to Blythe et al. a prior art alloy is disclosed comprising an aluminum-brass including from 6 to 30% manganese.

In U.S. Pat. No. 2,101,930 to Davis et al. an aluminum-brass is disclosed having optionally up to 1% manganese In U.S. Pat. No. 2,400,234 to Hudson a nickel aluminum-brass is disclosed having from 0.5 to 2.5% manganese. None of the patents to Ellis, Blythe et al., Davis et al and Hudson disclose an alloy within the ranges of this invention. British Pat. No. 833288 discloses a beta brass including aluminum, iron and nickel or cobalt and optionally manganese. British Pat. No. 838762 discloses a copper, zinc, titanium and/or zirconium alloy which may include 0.25 to 2% of one or more of the metals chromium, manganese, iron, cobalt and nickel.

SUMMARY OF THE INVENTION

The present invention relates to an alloy having improved stress relaxation resistance while maintaining good bend formability, high strength and acceptable electrical conductivity. The alloy comprises a manganese modified aluminum brass. The copper base alloy of this invention consists essentially of: zinc from about 15.0 to 31% by weight; aluminum from about 1.0 to about 5.0% by weight; manganese from about 1.1 to 8% by weight; and the balance essentially copper. Preferably, the manganese content of the alloy is from about 1.1 to 6% and most preferably from about 1.2% to about 4%. Preferably, the zinc content is from about 16 to 25%. The aluminum is from about 2.0 to 4% and most preferably from about 0.1 to 0.5%.

Silicon is preferably less than 0.1%. Other elements may be present in desired amounts which will not adversely affect the properties may be included though preferably at impurity levels.

The alloys as above noted provide substantially improved stress relaxation resistance at elevated temperatures, as compared to presently available commercial alloys, such as CDA Copper Alloy C68800.

Accordingly, it is an object of this invention to provide an improved aluminum-brass alloy having improved stress relaxation resistance.

It is further an object of this invention to provide an alloy as above which is modified by the addition of manganese within desired limits.

These and other objects will become more apparent from the following description and drawings.

DETAILED DESCRIPTION OF THE PREFERRED EMBODIMENTS

In accordance with the present invention it has been found that the foregoing objects can be readily and conveniently achieved with an alloy of the following composition. The improved alloy of the present invention consists essentially of the ingredients in the following ranges wherein all percentages are by weight:

about 15.0 to 31% zinc;
about 1.0 to 5.0% aluminum;
about 1.1 to 8% manganese;
and the balance essentially copper.

Preferably, the aforenoted alloy has a composition within the following ranges:

about 2.5 to 4% aluminum;
about 15 to 25% zinc;
about 1.1 to 6% manganese;
and the balance essentially copper.

Most preferably, the manganese content of the aforenoted alloy is from about 1.2 to about 4%.

Silicon is preferably less than about 0.1%. Other elements may be present in amounts which will not adversely affect the properties of the alloy and preferably at or below impurity levels.

The alloys of the present invention depart in particular from those disclosed in the prior art by the addition of manganese for improving the stress relaxation resistance of the alloy while maintaining its other favorable properties. The prior art does not recognize that the addition of manganese within the limits set forth herein surprisingly improves the stress relaxation resistance of aluminum brass.

The alloys of the present invention are known as modified aluminum brasses and basically have either of the following structures: (1) an alpha (face centered cubic) structure; or (2) an alpha plus a limited amount of beta (body centered cubic) structure, preferably less than 10% beta. The alloy is preferably a single phase solid solution alloy comprising essentially all alpha phase. The presence of beta phase in the alloy should be avoided because it adversely affects the cold workability of the alloy. Aluminum is added to the alloy for its strengthening effect.

The ranges in accordance with this invention are in every sense critical. The copper content must fall within the range of 67 to 80% by weight. Above 80% by weight, the strength falls off markedly, and below 67% by weight in saturated alloys an additional phase termed gamma having a complex cubic crystal structure may be encountered with slow cooling cycles which will limit the ductility of the alloy.

The composition of specific alloys within the above ranges are subject to further internal restriction that at about the lower levels of copper the aluminum content should preferably be in the range of 1.5 to 4.0 in order to insure high ductility-strength characteristics and at the higher level of copper the aluminum content should preferably be between 2.5 and 5.0% for the same reasons. Proportionate adjustments of aluminum content for the various copper contents between specified limits should preferably be made.

Processing of the alloys of the present invention requires no unusual treatment and is essentially similar to that described in U.S. Pat. No. 3,402,043.

The novel and improved characteristics of the alloys of this invention are associated with the addition of manganese in the range of from about 1.1 to 8%, and preferably from about 1.1 to 6%, and most preferably from about 1.2 to 4%.

With up to about 2% manganese there is believed to be a sharp increase in the percent stress remaining at 100,000 hours at 105° C. with increasing manganese content. The presence of 1.1% manganese insures at least a 10% improvement in stress relaxation resistance, as compared to an alloy without manganese and preferably an improvment of at least 30% in stress relaxation resistance. Above 2% manganese, it is believed that there is a leveling off of the improvement in stress relaxation resistance with increasing manganese content. Therefore, the most preferred range of manganese in accordance with this invention is from about 1.2% manganese to about 4% manganese.

The upper limit of manganese is dictated by the adverse effect of manganese on the conductivity of the alloy. However, an alloy in accordance with the present invention having 1.1% manganese will still achieve an electrical conductivity in excess of 10% IACS. The manganese addition to the alloys of this invention also has a favorable impact on the bend formability of the alloy.

The present invention will more readily be understood from a consideration of the following illustrative examples:

EXAMPLE I

Alloys were prepared having nominal compositions as set forth in Table I.

TABLE I

| | NOMINAL COMPOSITIONS Weight Percentages | | | | |
|---|---|---|---|---|---|
| Alloy No. | Cu | Zn | Al | Co | Mn |
| 1 | 73.5 | 22.70 | 3.4 | 0.4 | — |
| 2 | 73.9 | 18.70 | 3.4 | — | 4.0 |

The alloys were cast by the Durville method from a temperature of about 1090° C. Alloy 1 represents the commercial composition of CDA Copper Alloy C68800. Alloy 2 represents an alloy in accordance with this invention. Alloy 2 shows the effect of manganese additions on copper-zinc-aluminum alloys.

After casting the alloys were soaked at 840° C. for two hours and hot-rolled to about 0.4 inch gauge. They were then annealed at 500° C. for four hours, surface milled, cold-rolled and interannealed as required, at about 450° to 550° C. for one hour, to provide strip at 0.030 inch gauge after a final cold reduction of either 20% or 45%.

The tensile properties of the alloys with respective 20 or 45% final cold reductions are set forth in Table 2.

TABLE 2

| | TENSILE PROPERTIES | | |
|---|---|---|---|
| Alloy No. | 0.2% YS, ksi | UTS, ksi | % Elong. |
| 20% CR | | | |
| 1 | 87.8 | 104 | 9.5 |
| 2 | 80.0 | 90.5 | 16 |
| 45% CR | | | |
| 1 | 100.0 | 125.0 | 3.0 |
| 2 | 104.3 | 119.8 | 2.8 |

A comparison of the properties of the alloy 2 with that of alloy 1 shows that it has lower tensile strength relative to commercial alloy CDA C68800.

EXAMPLE II

Bending stress relaxation tests were conducted on each of the alloys from Example I at 105° C. after 20% and 45% cold reductions respectively. In these tests, specimens were initially loaded to a stress equivalent to about 80% of the 0.2% yield strength and stress remaining was then measured as a function of time. The stress relaxation data are compiled in Table 3 which shows the stress remaining in percent stress remaining after 1,000 and 100,000 hours. Percent stress remaining represents the relaxation resistance of the alloy with strength differences normalized out.

TABLE 3

| | STRESS RELAXATION DATA AT 105° C. | | | | |
|---|---|---|---|---|---|
| Alloy No. | Initial Stress ksi | Stress Remaining After 1,000 Hours, ksi | % Stress Remaining After 1,000 Hours | Stress Remaining After 100,000 Hours, ksi | % Stress Remaining After 100,000 Hours |
| 20% CR | | | | | |
| 1 | 69.1 | 43 | 62 | 32 | 47 |
| 2 | 63.2 | 53 | 84 | 49 | 78 |
| 45% CR | | | | | |
| 1 | 77.8 | 45 | 57 | 33 | 42 |
| 2 | 82.7 | 62 | 75 | 55 | 66 |

The above data show that the alloy of this invention with manganese provides a substantial improvement in stress remaining and percent stress remaining compared to CDA copper alloy C68800. These improvements are found over a wide range of zinc and aluminum contents.

The manganese addition adversely affects the electrical conductivity of the alloy, however, the alloy can achieve acceptable levels of conductivity over a wide range of manganese contents. Preferably the maximum manganese content is about 2.5% if at least 10% IACS conductivity is desired.

Definition of Abbreviations

YS = yield strength at 0.2% offset
UTS = ultimate tensile strength
ksi = thousands of pounds per square inch
% Elong. = percent elongation in a two inch gauge length
MBR = minimum bend radius
R/t = ratio of minimum bend radius to strip thickness
All percentage compositions set forth herein are by weight.

The Patents set forth in this application are intended to be incorporated by reference herein.

It is apparent that there has been provided in accordance with this invention an improved copper base alloy which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A copper base alloy having improved stress relaxation resistance consisting essentially of: about 15.0 to 31% zinc; about 2.5 to 4% aluminum; about 1.1 to 8% manganese and the balance essentially copper the copper content being less than 80% copper.

2. An alloy as in claim 1 wherein manganese is present from about 1.1 to 6%.

3. An alloy as in claim 1 wherein manganese is present from about 1.2 to 4%.

4. An alloy as in claim 2 wherein zinc is present from about 15 to 25%.

5. An alloy as in claim 4 wherein manganese is present from about 1.2 to 4%.

6. An alloy as in claim 5 having an essentially all alpha phase microstructure.

7. An alloy as in claim 5 in the cold worked condition.

8. An alloy as in claim 4 having an electrical conductivity of at least 10% IACS and wherein said manganese is from about 1.1 to 2.5%.

9. A copper base alloy having improved stress relaxation resistance consisting essentially of: about 15.0 to 31% zinc; about 1.0 to 5.0% aluminum; about 1.2 to 4% manganese and the balance essentially copper, the copper content being less than 80% copper.

10. An alloy as in claim 9 wherein aluminum is from about 2.5 to 4%; and zinc is from about 15 to 25%.

* * * * *